US007275597B2

(12) United States Patent
Hall et al.

(10) Patent No.: US 7,275,597 B2
(45) Date of Patent: Oct. 2, 2007

(54) REMOTE POWER MANAGEMENT METHOD AND SYSTEM IN A DOWNHOLE NETWORK

(75) Inventors: David R. Hall, Provo, UT (US); David B. Bartholomew, Springville, UT (US); Roger O. Koehler, Provo, UT (US)

(73) Assignee: IntelliServ, Inc., Provo, UT (US)

( * ) Notice: Subject to any disclaimer, the term of this patent is extended or adjusted under 35 U.S.C. 154(b) by 319 days.

(21) Appl. No.: 10/906,668

(22) Filed: Mar. 1, 2005

(65) Prior Publication Data

US 2006/0196664 A1 Sep. 7, 2006

(51) Int. Cl.
*E21B 43/11* (2006.01)

(52) U.S. Cl. ..... 166/297

(58) Field of Classification Search ..... None
See application file for complete search history.

(56) References Cited

U.S. PATENT DOCUMENTS

| | | | | |
|---|---|---|---|---|
| 3,959,601 | A * | 5/1976 | Olevsky et al. | 375/376 |
| 4,709,234 | A | 11/1987 | Forehand et al. | |
| 5,784,004 | A | 7/1998 | Esfahani et al. | |
| 5,959,547 | A | 9/1999 | Tubel et al. | |
| 5,960,883 | A | 10/1999 | Tubel et al. | |
| 6,343,649 | B1 | 2/2002 | Beck et al. | |
| 6,459,383 | B1 | 10/2002 | Delatorre | |
| 6,670,880 | B1 | 12/2003 | Hall et al. | |
| 2002/0042256 | A1 * | 4/2002 | Baldwin et al. | 455/232.1 |
| 2005/0035874 | A1 | 2/2005 | Hall et al. | |

FOREIGN PATENT DOCUMENTS

| | | |
|---|---|---|
| GB | 2323109 | 9/1998 |

OTHER PUBLICATIONS

Jellison et al., SPE/IADC 79885 Telemetry Drill Pipe: Enabling Technology for the Downhole Internet: Amsterdam, The Netherlands, Feb. 19-21, 2003.

Jellison and Hall; SPE 80454; Intelligent Drill Pipe Creates the Drilling Network; Asia Pacific Oil and Gas Conference, Jakarta, Indonesia; Apr. 15-17, 2003.

* cited by examiner

*Primary Examiner*—Frank Tsay
(74) *Attorney, Agent, or Firm*—Jeffery E. Daly; Tyson J. Wilde

(57) ABSTRACT

A method for remotely managing downhole power consumption in a downhole network system is disclosed. The method comprises the steps of monitoring an activation state for each of a plurality of individually activatable electrically-powered modules in a downhole device and determining an optimal activation state for each module according to system demands. The activation state of each module may be selected from the group consisting of activated or deactivated. The method further comprises the step of transmitting a power state switching instruction from a top-hole processing element to a downhole power-consumption state controller over the downhole network. The method also includes the step of switching the selected electrically-powered modules according to the determined optimal activation states.

13 Claims, 5 Drawing Sheets

REMOTE POWER MANAGEMENT METHOD AND SYSTEM IN A DOWNHOLE NETWORK

BACKGROUND OF THE INVENTION

The present invention relates to power management in electronic devices. More particularly, it relates to remote power management in a downhole device connected to a downhole network.

In downhole operations such as drilling for oil, gas, and water, it is often very desirable to take and record measurements at selected points along a tool string and relay that information to surface equipment. U.S. Pat. No. 6,670,880 to Hall (hereafter referenced as the '880 patent), which is herein incorporated by reference for all that it teaches, discloses a downhole data transmission system which enables one or more downhole devices situated along a tool string to be connected through a downhole network to surface equipment.

One challenge in operating electronic devices in a downhole environment is that of providing them with electrical power. It is often difficult to supply downhole power from the surface of a drilling site, and as a result downhole electronic devices are often powered by special batteries. Batteries have a finite duration of operable utility, and a downhole battery may need to be replaced during drilling operations. In many cases, sensitive electronic equipment is placed in a sealed housing inside of a tool string component in order to protect it from downhole conditions. Under such circumstances, it is inconvenient to remove the sealed portion of the housing to access the equipment installed in the tool string component on a very frequent basis. Also, electronic equipment so housed may be extremely difficult to turn on and off once the tool string is downhole.

In addition to the difficulties in accessing them, another problem arises in the fact that electronic devices on a tool string may be left downhole for considerable amounts of time, thus draining power from the batteries.

Various attempts to maximize power efficiency in electronic apparatus have been made in the drilling industry. U.S. Pat. No. 4,709,234 to Forehand, which is incorporated herein by reference for all that it teaches, discloses a power-conserving apparatus that includes a plurality of independently energizable electrical circuits used in receiving electrical signals from a transducer which senses an environmental condition, in processing the electrical signals, and in storing information related to the detected environmental condition. The apparatus is self-monitoring, and may switch power between the independently energizable electrical circuits.

U.S. Pat. No. 5,960,883 to Tubel, which is incorporated herein by reference for all that it teaches, discloses a method of managing power in a control system in a production well, the control system including a plurality of downhole modules which require power and are addressable. The downhole modules are permanently deployed and are for controlling devices that are operatively associated with them. The method includes the steps of maintaining each module in a dormant, low-power state until activation is required and selectively activating one or more of the modules when activation is required.

U.S. Pat. No. 5,784,004 to Esfahami, which is incorporated herein by reference for all that it teaches, discloses an apparatus with a temperature sensor, a pressure sensor, and a control module. Energy is conserved by sending change-in temperature and change-in pressure data. The control module stores previous measurements, determines a "change-in" calculation, generates transmitter activation signals, and generates a control signal. The control module can go into a sleep mode, and is equipped with a wake-up delay generated by a counter.

U.S. patent application Ser. No. 10/710,638, filed in the name of David Hall on Jul. 27, 2004, and incorporated herein by reference for all that it teaches, discloses that a tool may receive power directly through the tool string; when the source of power is disconnected (e.g. during tripping operations), it may automatically go into a sleep mode powered by a small battery until reawakened by the reinstatement of tool string power.

BRIEF SUMMARY OF THE INVENTION

A method for remotely managing downhole power consumption in a downhole network system is disclosed. The downhole network system is preferably integrated into a downhole tool string. The method comprises the steps of monitoring an activation state for each of a plurality of individually activatable electrically-powered modules in a downhole device and determining an optimal activation state for each module according to system demands. The activation state for each module may be selected from the group consisting of activated or deactivated. The optimal activation state for each module may be the most power-efficient activation state for the evaluated downhole operating conditions. The step of determining an optimal activation state for each electrically-powered module may also comprise the step of evaluating downhole operating conditions of a tool string.

The method further comprises the step of transmitting a power state switching instruction from a top-hole processing element to a downhole power-consumption state controller. The instruction is sent over the downhole network and may be to independently activate or deactivate selected modules not operating in their determined optimal activation states. The method also comprises the step of switching the selected electrically-powered modules according to the determined optimal activation states. The activation state of modules may be switched by providing or cutting off an oscillator signal or a power supply to selected modules. The method may also comprise the additional step of transmitting a completion signal to the top-hole processing element.

A remote power management system for a downhole device in a downhole network comprises a top-hole processing element in communication with a downhole power-consumption state controller. The top-hole processing element may be selected from the group consisting of network servers, network nodes, electronic processors, and integrated circuits. The top-hole processing element may also be in communication with an external network. The downhole network is preferably integrated into a downhole tool string, and may further comprise a data transmission system of inductive couplers in tool string components.

The downhole power-consumption state controller is operably connected to a plurality of individually electrically-powered hardware modules in the downhole device. The downhole device may be a network node, an electronic processor, an integrated circuit, a downhole tool, a sensor, or other functional equipment for a downhole environment. The electrically-powered hardware modules are individually activatable. The downhole power-consumption state controller may be configured to alter a power-consumption state of the downhole device.

In select embodiments, the downhole power-consumption state controller is a downhole packet decoding unit. The downhole power-consumption state controller may also be an integrated circuit or an electronic processor. In preferred embodiments, the downhole power-consumption state controller is continuously active. Each electrically-powered hardware module may further comprise an oscillator signal generator module in communication with the downhole power-consumption state controller. The activation states of the modules may be altered by the downhole power-consumption state controller selectively providing or cutting off power and/or a clock signal.

DETAILED DESCRIPTION OF THE INVENTION AND THE PREFERRED EMBODIMENT

The following figures, in which like elements are labeled with like numerals, are intended to illustrate certain embodiments of the present invention, and not to limit its scope.

Figure 1:
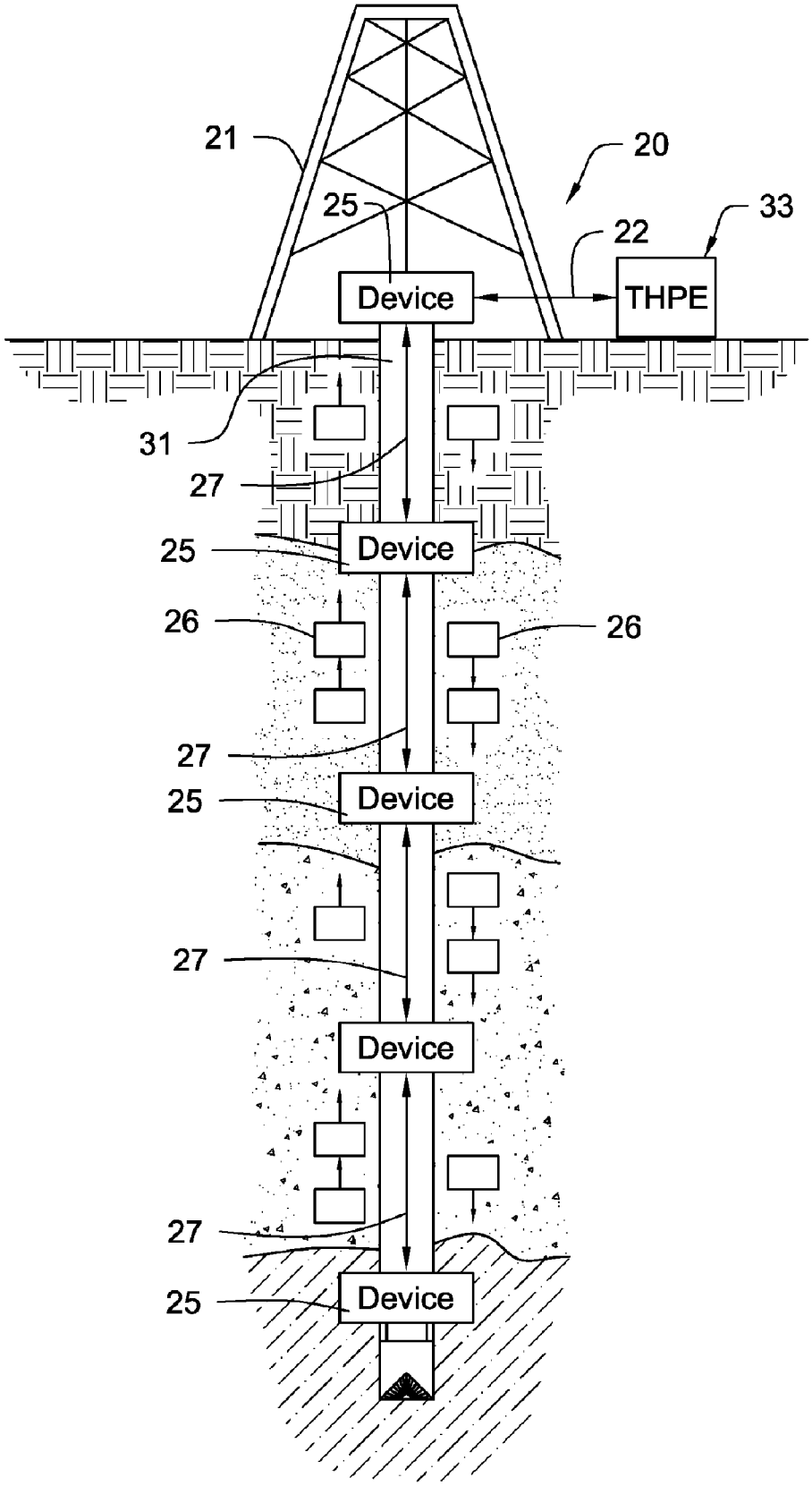
FIG. 1 is a depiction of a downhole network in accordance with the present invention and incorporated into a downhole tool string.

Referring to FIG. 1, the present invention is designed for use in a downhole network 20. For the purposes of this invention, a downhole network is defined as a system in which at least two physically separate devices, at least one of the devices being located beneath the surface of the earth, may communicate with each other at a data rate of greater than or equal to 30.0 kilobits per second. In this embodiment, the downhole network 20 is incorporated into a downhole tool string 31 in a drilling rig 21. The downhole network 20 comprises a top-hole processing element 33 in communication with a plurality of downhole devices 25 such as network nodes incorporated into the downhole tool string 31. The top-hole processing element 33 may comprise a network server. In other embodiments, the top-hole processing element may comprise at least one element of the group consisting of network nodes, electronic processors, and integrated circuits. The top-hole processing element 33 may also be connected to an external network (not shown) such as a local area network (LAN), a satellite network, the internet, a global positioning system (GPS) network, or the like.

The top-hole processing element 33 comprises a connection 22 to the rest of the downhole network 20. This connection 22 may be a wireless data connection, or a physical data connection such as that of a swivel assembly. Data may be transmitted between devices 25 in the downhole network 20 through a data transmission path 27 in the downhole tool string 31. A preferred system for transmitting data up and down the tool string 31 comprises inductive couplers in tool joints and is disclosed in the previously referenced '880 patent to Hall. Alternate data transmission paths 29 may comprise direct electrical contacts in tool joints such as in the system disclosed in U.S. Pat. No. 6,688,396 to Floerke, et al., which is herein incorporated by reference for all that it teaches. Another data transmission system that may be adapted for use with the present invention is U.S. Pat. No. 6,641,434 to Boyle, et al.; which is also herein incorporated by reference for all that it teaches. In other embodiments optical couplers may be used to transmit data from one downhole component to another.

As in most networks, data may be transmitted between downhole devices 25 in a downhole network by electronic packets 26. Packets 26 may be transmitted up and down the tool string. The digital information contained in the electronic packets 26 may be modulated on an analog signal when transmitted between downhole devices 25.

Figure 2:
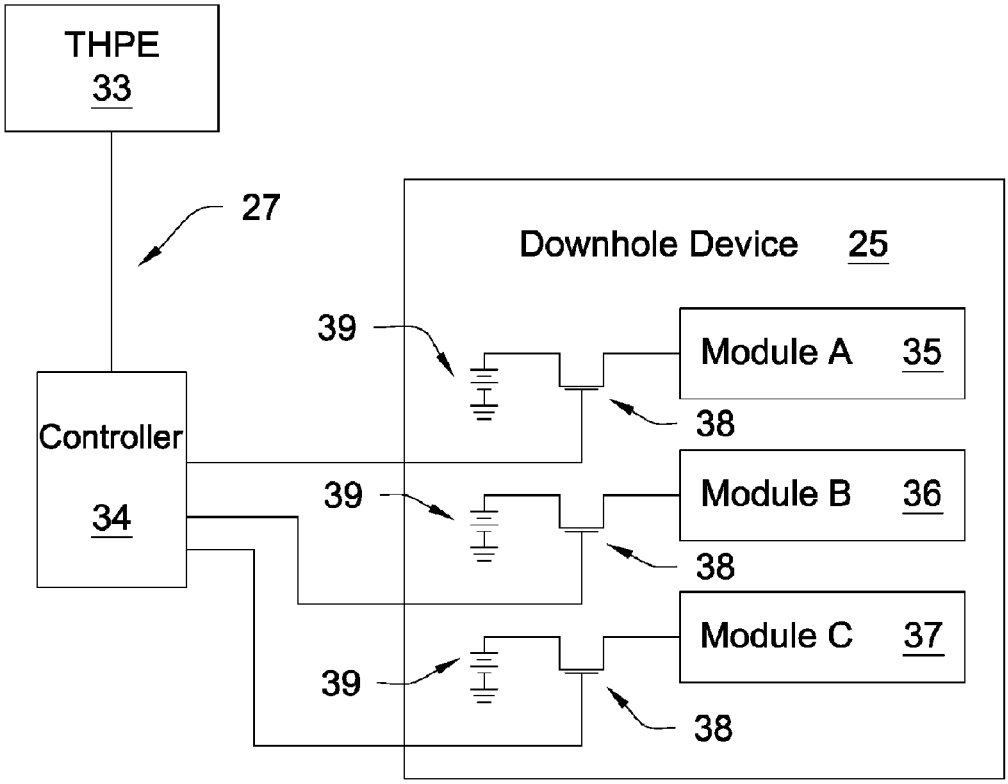
FIG. 2 is an electronic schematic of one embodiment of a remote power management system in a downhole network.

Referring now to FIG. 2, a downhole device 25 comprises a plurality of electrically-powered hardware modules 35, 36, 37 which may be configured to execute application-specific tasks. The electrically-powered hardware modules 35, 36, 37 may comprise amplifiers, tuners, electronic processors, integrated circuits, modems, analog-to-digital converters, digital-to-analog converters, repeaters, optical regenerators, memory, routers, switches, multiplexers, encryption circuitry, power sources, clock sources, error checking circuitry, data compression circuitry, data rate adjustment circuitry, and the like.

The electrically-powered hardware modules 35, 36, 37 are individually activatable. In other words, the modules 35, 36, 37 do not necessarily depend on the activation status of each other in order to be activated or deactivated individually. The electrically-powered hardware modules 35, 36, 37 may be switched to an activated or a deactivated state by enabling or disabling a power signal from a power source. The downhole device 25 comprises a plurality of possible power-consumption states. These states may be off, dormant, low-power, or fully-on. The power-consumption state of the downhole device 25 may be determined by the number of electrically-powered hardware modules 35, 36, 37 that are currently activated. For example, the off power-consumption state may occur when no power is supplied to any of the electrically-powered hardware modules 35, 36, 37. In another example, the fully-on power-consumption state of the downhole device 25 may occur when power is being supplied to all of the electrically-powered hardware modules 35, 36, 37.

One significant feature of the present invention is the use of a downhole power-consumption state controller 34 operably connected to the top-hole processing element 33 through the data transmission path 27 of the network and the electrically-powered hardware modules 35, 36, 37 of the downhole device. The downhole power-consumption state controller 34 may comprise any of the group consisting of packet decoder units, integrated circuits, software, and electronic processors. In the preferred embodiment, the downhole power-consumption state controller 34 is maintained in a continuously active state. The downhole power-consumption state controller 34 is configured to receive instructions from the top-hole processing element 33.

The downhole power-consumption state controller 34 is configured to selectively alter the power-consumption state of the downhole device 25. The downhole power-consumption state controller 34 may alter the power-consumption state of the downhole device 25 by selectively switching specific electrically-powered hardware modules 35, 36, 37 to activated or deactivated states. The downhole power-consumption state controller 34 may also comprise at least one switching element 38 connected between a local power source 39 and at least one electrically-powered hardware module 35, 36, 37. In this particular embodiment of the invention, the switching element 38 is a transistor and the local power source 39 is a downhole battery. With such a configuration, the downhole power-consumption state controller 34 may provide a HIGH voltage (i.e. a digital '1' signal) to the gates of transistors of electrically-powered hardware modules 35, 36, 37 that require power for the current power-consumption state while maintaining a LOW voltage (i.e. a digital '0' signal) at the gates of transistors of electrically-powered hardware modules 35, 36, 37 that do not require power for the current power-consumption state. Also in this embodiment, each electrically-powered hardware module 35, 36, 37 is connected to a separate local power supply 39 with a separate switching element 38 wherein all of the switching elements 38 are governed by the downhole power-consumption state controller 34.

Another significant feature of the present invention is the fact that the downhole power-consumption state controller 34 is configured to receive instructions from the top-hole processing element 33 with regard to altering the state of the individual electrically-powered modules 35, 36, 37. For example, in this embodiment of the invention, if the top-hole processing element 33 were to transmit an instruction to the downhole power-consumption state controller 34 to switch all of the hardware modules 35, 36, 37 to an activated state, the downhole power-consumption state controller 34 would be configured to electronically enable the power signal to all of the electrically-powered hardware modules 35, 36, 37.

Figure 3:
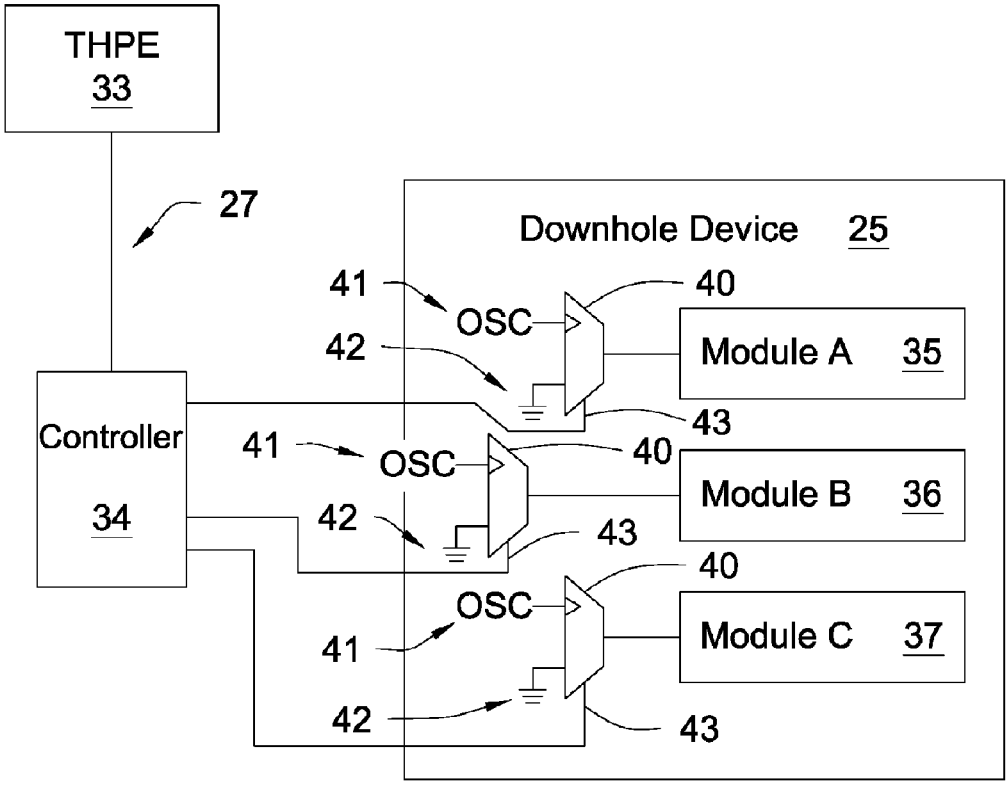
FIG. 3 is an electronic schematic of another embodiment of a remote power management system in a downhole network.

Referring now to FIG. 3, in some embodiments the electrically-powered hardware modules 35, 36, 37 may be oscillator-controlled hardware modules. For the purposes of this invention, an oscillator-controlled hardware module is defined as an electrically-powered hardware module that requires input from an oscillator 41 such as a clock source to execute its specified functions. In such cases, another suitable method of activating or deactivating individual modules 35, 36, 37 may be to selectively enable or disable an oscillator signal connected to an individual module 35, 36, 37.

In this embodiment of the invention, each of the hardware modules 35, 36, 37 comprises a 2-1 digital multiplexer 40. The multiplexers 40 are configured to output either a signal from the oscillator 41 or a connection to ground 42 according to input data from a select line 43. The output signal from each multiplexer 41 is coupled to the oscillator signal input of a hardware module 35, 36, 37. The select line 43 of each multiplexer 40 is operably connected to the downhole power-consumption state controller 34. In this manner, output from the downhole power-consumption state controller 34 determines whether or not a specific oscillator-controlled module 35, 36, 37 receives input from the oscillator 41. Thus, if the top-hole processing element 33 transmits an instruction through the data transmission path 27 of the downhole network 20 to the downhole power-consumption state controller 34 to alter the power-consumption state of the downhole device 25, the downhole power-consumption state controller 34 is configured to selectively switch individual oscillator-controlled modules 35, 36, 37 to achieve the requested power-consumption state.

In other embodiments of the invention, an oscillator signal may be disabled or enabled by a pass transistor or other electronic component.

Figure 4:
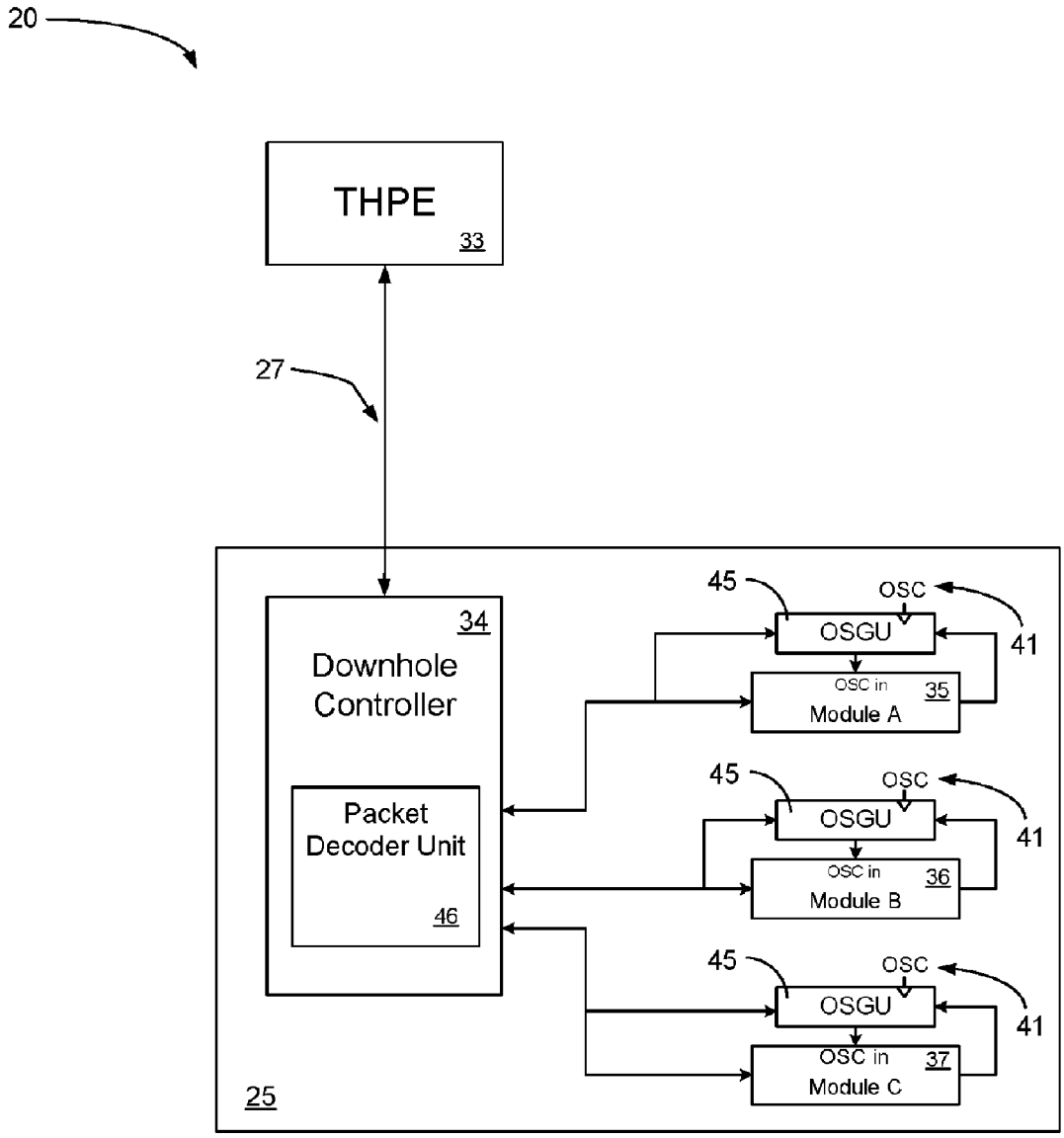
FIG. 4 is an electronic schematic of another embodiment of a remote power management system in a downhole network.

Referring now to FIG. 4, another embodiment of a remote power management system in a downhole network 20 in accordance with the present invention is depicted. The top-hole processing element 33 is in communication with a downhole power-state consumption controller 34 over a data transmission path 27 comprised by the downhole network 20. The downhole power-state consumption controller may comprise a packet decoder unit 46 that is operably connected to a plurality of oscillator-controlled hardware modules 35, 36, 37 in a downhole device 25. Each oscillator-controlled hardware module 35, 36, 37 may also be operably connected to an oscillator signal generator module (OSGM) 45. The oscillator signal generator modules 45 may receive input from an oscillator 41 such as a system clock. When not processing instructions, oscillator-controlled hardware modules 35, 36, 37 may be maintained continuously in a dormant state by simply not routing an oscillator signal from the oscillator signal generator modules 45 to the oscillator-controlled hardware modules 35, 36, 37.

The packet decoder unit 46 is configured to receive packets 26 of digital information from the downhole network 20. When a packet 26 is received by the downhole power-state consumption controller 34, the downhole packet decoder unit 46 is adapted to route the instruction along with any necessary parameters to one or more of the oscillator-controlled hardware modules 35, 36, 37 to which it corresponds. The packet decoder unit 46 may determine to which oscillator-controlled hardware module 35, 36, 37 the instruction corresponds by decoding information in a certain part of the packet 26 received, such as a header.

In this embodiment, the downhole packet decoder unit 46 is also able to send an instruction to the oscillator signal generator module(s) 45 in communication with the selected oscillator-controlled hardware module(s) 35, 36, 37 to begin routing the oscillator signal to the appropriate oscillator-controlled hardware module(s) 35, 36, 37. In some embodiments, the oscillator-controlled hardware module(s) 35, 36, 37 may already have a predetermined task to perform and only require activation to perform it. In other embodiments, the downhole packet decoder unit 46 may route additional instructions and/or necessary parameters to the selected oscillator-controlled hardware module(s) 35, 36, 37. Upon receiving an oscillator signal, an oscillator-controlled hardware module 35, 36, 37 becomes activated and may thus begin processing the instruction routed to it from the downhole packet decoder unit 46. In some embodiments, the oscillator signal generator module 45 may route the oscillator signal to its corresponding oscillator-controlled hardware module 35, 36, 37 for a predetermined amount of time. In preferred embodiments, when an oscillator-controlled hardware module 35, 36, 37 completes all tasks related to the instruction routed to it by the downhole packet decoder unit 46 it sends a signal to its corresponding oscillator signal generator module 45. Upon receiving the signal, the oscillator signal generator module 45 may discontinue routing the oscillator signal to its corresponding oscillator-controlled hardware module 35, 36, 37 and thus deactivate it.

In this manner, the top-hole processing element 33 may transmit an instruction over the downhole network 20 to activate or deactivate a specific oscillator-controlled hardware module 35, 36, 37 in order to change the power-consumption state of the downhole device 25. Logic found in the downhole packet decoder unit 46 and the oscillator signal generator module 45 may enable the instruction to be carried out.

Figure 5:
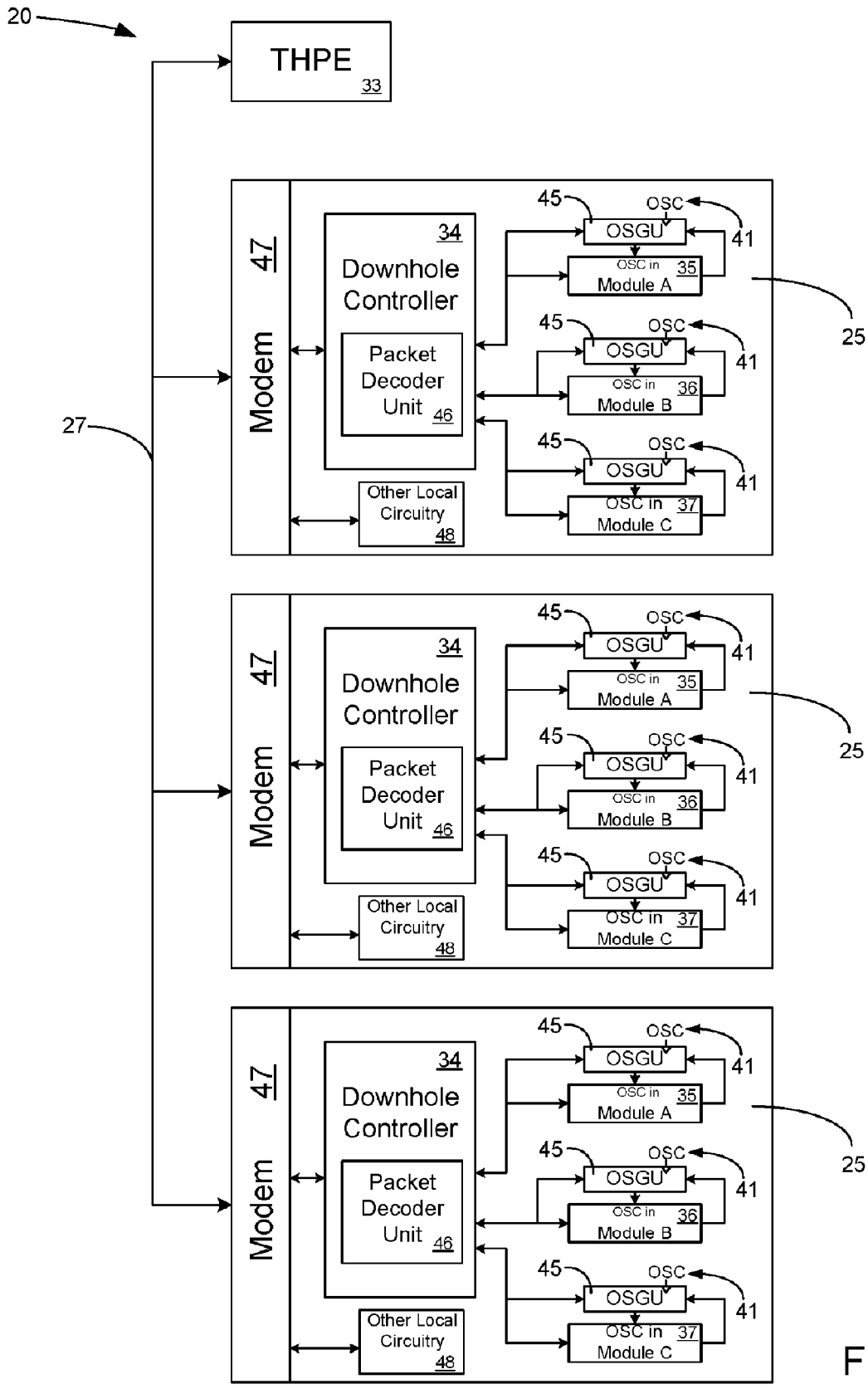
FIG. 5 is an electronic schematic of a preferred embodiment of a remote power management system in a downhole network.

Referring now to FIG. 5, a downhole network 20 may comprise a plurality of downhole devices 25 comprising systems according to the present invention. In this figure, the downhole devices 25 all comprise remote power-management systems according to the embodiment of FIG. 4.

Specifically, each downhole device 25 comprises a downhole power consumption state controller 34 which in turn comprises a packet decoder unit 46 operably connected to a plurality of oscillator-controlled hardware modules 35, 36, 37, oscillator signal generator modules 45, and a local oscillator 41 as described more fully in the description of FIG. 4. Each downhole device 25 is configured to receive instructions from the top-hole processing element 33, and may also communicate with other downhole devices 25. In some embodiments, downhole devices 25 may comprise sufficient intelligence to send power management instructions to other downhole devices 25 in the network. While all of the downhole devices 25 in FIG. 5 are depicted as incorporating the embodiment of the invention disclosed in FIG. 4, it is also possible to incorporate multiple instances of another embodiment or multiple instances of multiple embodiments of the present invention in a single downhole network 20. Downhole devices 25 in the downhole network 20 may also comprise modulator/demodulators (modems) 47 and other local circuitry 48 not affiliated with remote power management systems of the present invention.

Figure 6:
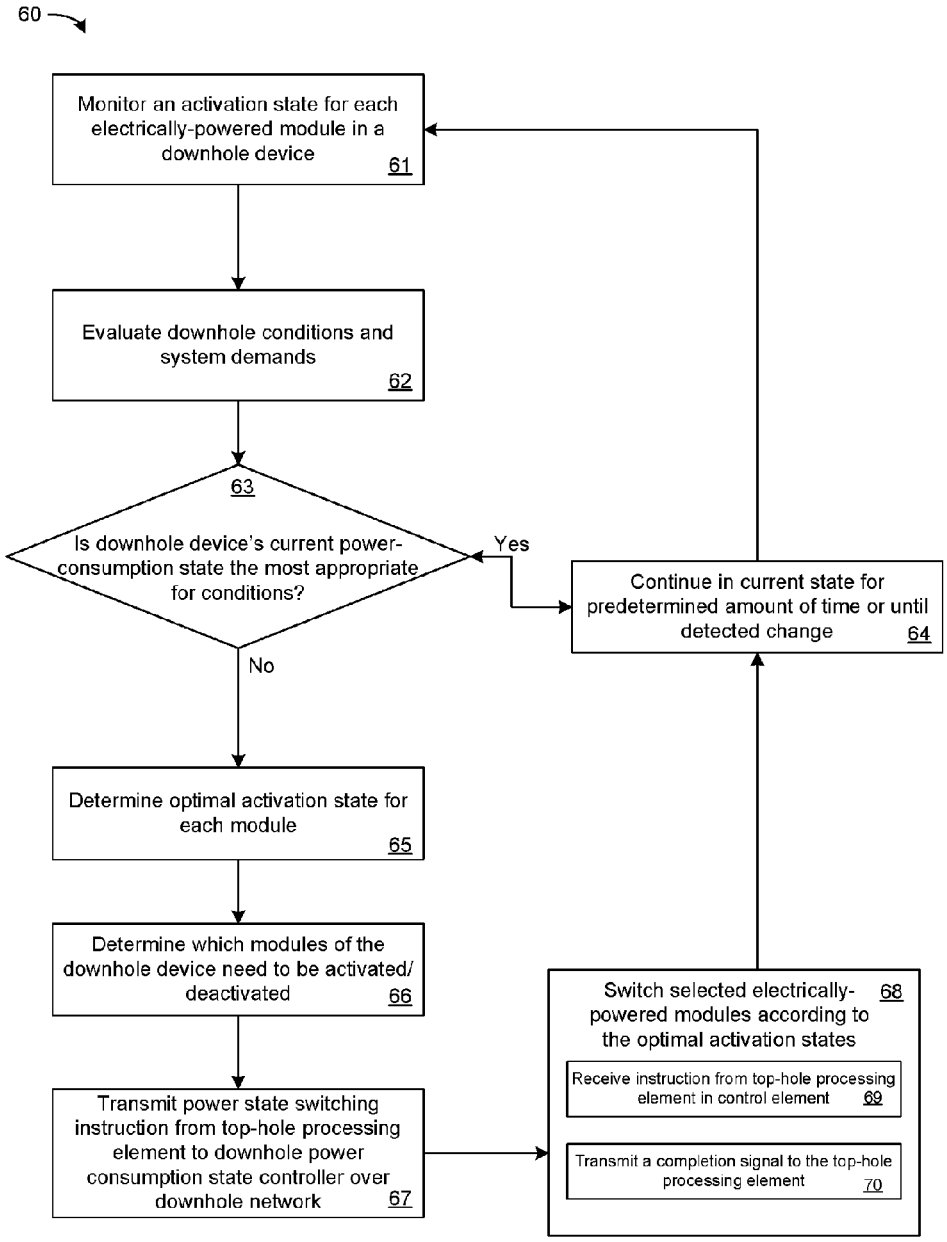
FIG. 6 is a flowchart illustrating a method for remotely managing power in a downhole network.

Referring now to FIG. 6, a method 60 for remotely managing power in a downhole network 20 is disclosed. The method 60 comprises the step of monitoring 61 an activation state for each electrically-powered module 35, 36, 37 in a downhole device 25.

The activation states may be monitored by a top-hole processing element 33 in communication with the downhole device 25. The downhole device may comprise specific circuitry for reporting the activation state of each of its modules to the top-hole processing element 33. In this particular embodiment, the method also comprises the step of evaluating 62 downhole operating conditions of a downhole device 25. The downhole operating conditions of the downhole device 25 may be received and evaluated by a top-hole processing element 33. The downhole operating conditions may be drilling conditions of a downhole tool string 31. In some embodiments, the downhole operating conditions may be operating conditions at a specific point on the downhole tool string 31. The downhole operating conditions may be system demands. One example of a system demand may be the requirement for a certain electrically-powered module 35, 36, 37 to be in an activated state in order to carry out a downhole task.

The method 60 also preferably comprises the step of analyzing 63 if the downhole device 25 is operating in the most appropriate state for the conditions evaluated in step 62. The most appropriate operating state for the downhole device 25 may be the most power-efficient operating state for the downhole operating conditions while meeting system demands. The current operating state of the downhole device 25 may be determined by the current activation status of individual electrically-powered hardware modules 35, 36, 37 in the downhole device 25.

If the downhole device 25 is found to be in the most appropriate operating state for the evaluated conditions, it may continue 64 in its current operating state for a predetermined amount of time or until some other detected change, such as a change in system demands, triggers the step of analyzing 63 to be repeated. If the downhole device 25 is not found to be operating at the most appropriate state for the evaluated conditions and system demands, the optimal activation state for each specific electrically-powered hardware module 35, 36, 37 may be determined 65, preferably by the top-hole processing element 33. The activation state of the electrically-powered hardware modules 35, 36, 37 may be selected from the group consisting of power being available to the module 35, 36, 37, power being unavailable to the module 35, 36, 37, an oscillator signal being available to the module 35, 36, 37, and an oscillator signal being unavailable to the module 35, 36, 37. This may further entail the step of determining 66 which of the electrically-powered hardware modules 35, 36, 37 need to be activated or deactivated in order to achieve the desired operating state in the downhole device 25.

The method 60 also comprises the step of transmitting 67 a power state switching instruction from the top-hole processing element 33 to a downhole power-consumption state controller 34 over the downhole network 20. The downhole power-consumption state controller 34 of this method 60 is consistent with descriptions of the downhole power-consumption state controller 34 in previous figures. A downhole power-consumption state controller may comprise a packet decoder unit 46.

The method further comprises the step of switching 68 the selected electrically-powered modules 35, 36, 37 according to the optimal activation states. Preferably, the switching 68 is performed by the downhole power-consumption state controller 34. In some embodiments, the downhole power-consumption state controller 34 may selectively switch 68 individual modules 35, 36, 37 by selectively providing or cutting off power to the modules 35, 36, 37. In other embodiments, the downhole power-consumption state controller 34 may switch 68 the modules 35, 36, 37 by selectively providing or cutting of a clock signal.

The step of switching 68 the selected modules 35, 36, 37 may also comprise the additional steps of receiving 69 the transmission in the downhole power-consumption state controller 34 and transmitting 70 a completion signal to the top-hole processing element 33 when the selected modules have been switched.

Once the selected modules 35, 36, 37 of the downhole device 25 have been switched 68, the downhole device 25 may continue 64 in its current state for a predetermined amount of time or until a detected change occurs as previously mentioned.

Whereas the present invention has been described in particular relation to the drawings attached hereto, it should be understood that other and further modifications apart from those shown or suggested herein, may be made within the scope and spirit of the present invention.

What is claimed is:

1. A remote power management system for a downhole device in a downhole network, comprising:

a top-hole processing element in communication with a downhole power-consumption state controller over the downhole network;

the downhole power-consumption state controller being operably connected to a plurality of individual oscillator-controlled hardware modules in the downhole device and comprising a packet decoder unit and an oscillator signal generator module corresponding to each oscillator-controlled hardware module;

wherein the top-hole processing element is adapted to selectively monitor and switch specific hardware modules through the downhole power-consumption state controller according to system demands.

2. The system of claim 1, wherein the oscillator signal generator modules further comprise a connection to a local clock source.

3. The system of claim 1, wherein the downhole packet decoder unit is adapted to utilize information in network packets to selectively activate and deactivate individual oscillator signal generator modules.

4. The system of claim 1, wherein the downhole packet decoder unit is configured to selectively activate and deactivate individual oscillator signal generator modules according to header information in the network packets.

5. The system of claim 1, wherein each oscillator signal generator module is configured to relay an oscillator signal to its associated oscillator-controlled hardware module.

6. The system of claim 1, wherein each oscillator-controlled hardware module is configured to send a signal to the oscillator signal generator module indicating completion of a task.

7. The system of claim 6, wherein the oscillator signal generator module is configured to cut off the oscillator signal to the oscillator-controlled hardware module upon receiving the signal indicating completion of the task.

8. The system of claim 1, wherein the downhole packet decoder unit is continuously active.

9. The system of claim 1, wherein the downhole network is a downhole network integrated into a tool string.

10. The system of claim 1, wherein the top-hole processing element comprises at least one element of the group consisting of network servers, network nodes, electronic processors, and integrated circuits.

11. The system of claim 1, wherein the top-hole processing element is operably connected to an external network.

12. The system of claim 1, wherein the downhole device is selected from the group consisting of network nodes, electronic processors, integrated circuits, downhole tools, sensors, and combinations thereof.

13. The system of claim 1, wherein the downhole oscillator-controlled hardware modules are selected from the group consisting of amplifiers, tuners, electronic processors, integrated circuits, modems, repeaters, optical regenerators, memory, routers, switches, multiplexers, encryption circuitry, power sources, clock sources, error checking circuitry, data compression circuitry, tool ports, and data rate adjustment circuitry.

* * * * *